US011850880B1

(12) United States Patent
Caruso

(10) Patent No.: US 11,850,880 B1
(45) Date of Patent: Dec. 26, 2023

(54) MARKER RETENTION AND ROTATION DEVICE

(71) Applicant: Anthony Caruso, Clearwater Beach, FL (US)

(72) Inventor: Anthony Caruso, Clearwater Beach, FL (US)

( * ) Notice: Subject to any disclaimer, the term of this patent is extended or adjusted under 35 U.S.C. 154(b) by 0 days.

(21) Appl. No.: 18/344,983

(22) Filed: Jun. 30, 2023

(51) Int. Cl.

| | |
|---|---|
| ***B43K 23/06*** | (2006.01) |
| ***B43K 8/03*** | (2006.01) |
| ***B43K 23/08*** | (2006.01) |
| ***B43M 99/00*** | (2010.01) |

(52) U.S. Cl.
CPC ..... *B43K 23/06* (2013.01); *B43K 8/03* (2013.01); *B43K 23/08* (2013.01); *B43M 99/006* (2013.01)

(58) Field of Classification Search
CPC ..... B43K 23/06; B43K 23/08; B43M 99/006
USPC ..... 401/131
See application file for complete search history.

(56) References Cited

U.S. PATENT DOCUMENTS

| | | | | |
|---|---|---|---|---|
| 4,573,818 | A * | 3/1986 | Kodera | B43K 25/022 401/35 |
| 9,751,358 | B2 * | 9/2017 | Sferle | B43K 23/12 |
| 10,638,822 | B2 * | 5/2020 | Fagu | B43M 99/006 |
| 2017/0043611 | A1 * | 2/2017 | Van Der Zande | B43K 23/06 |
| 2021/0291578 | A1 * | 9/2021 | Dhanapalan | B43K 23/06 |

FOREIGN PATENT DOCUMENTS

| | | | | |
|---|---|---|---|---|
| EP | 3262969 | A1 * | 1/2018 | A45C 11/34 |

* cited by examiner

*Primary Examiner* — Jennifer C Chiang
(74) *Attorney, Agent, or Firm* — Larson & Larson; Justin P. Miller; Frank Liebenow

(57) ABSTRACT

The marker rotation and retention device maintains multiple markers together, making it easier for a user to maintain the markers as a set. Optionally, the marker rotation and retention device includes angular rotation stops that are able to hold the angular position of specific marker with respect to its neighbors. This allows the user to easily withdraw and replace a specific marker by keeping the entrance to the cap exposed.

18 Claims, 9 Drawing Sheets

MARKER RETENTION AND ROTATION DEVICE

FIELD

This invention relates to the field of writing instruments and more particularly to a system for retaining markers to prevent loss of caps.

BACKGROUND

It is common for markers, or other writing implements, to come in a variety of colors. Initially, the markers are received packaged together to avoid loss of any individual marker.

But as soon as the members are removed from package, they are no longer associated with each other. The markers can then be lost individually, or just the caps misplaced.

What is needed is a way to keep a set of markers together, while also making it easier to select and return a specific marker.

SUMMARY

The marker rotation and retention device maintains multiple markers together, making it easier for a user to keep the markers as a set. Optionally, the marker rotation and retention device includes rotation stops that hold the angular position of a specific marker with respect to its neighbors. This allows the user to easily withdraw and replace a specific marker by keeping the entrance to the cap exposed.

In the preferred embodiment, the rotation stops take the form of splined connections, with the marker cap and a central shaft meeting at a spline interface. The use of resilient and/or flexible materials allows the teeth of the splines to snap past each. This allows the user to rotate a cap to at a particular position with respect to the shaft, the teeth of the splines snapping past each other during rotation, and then locking into place to hold a particular angular position. The splined connection can also be referred to as connection using grooves, teeth, protrusions and channels, or mating ribs.

In alternative embodiments, the spline interface is replaced with balls that lock into detents creating the same angular holding position action.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
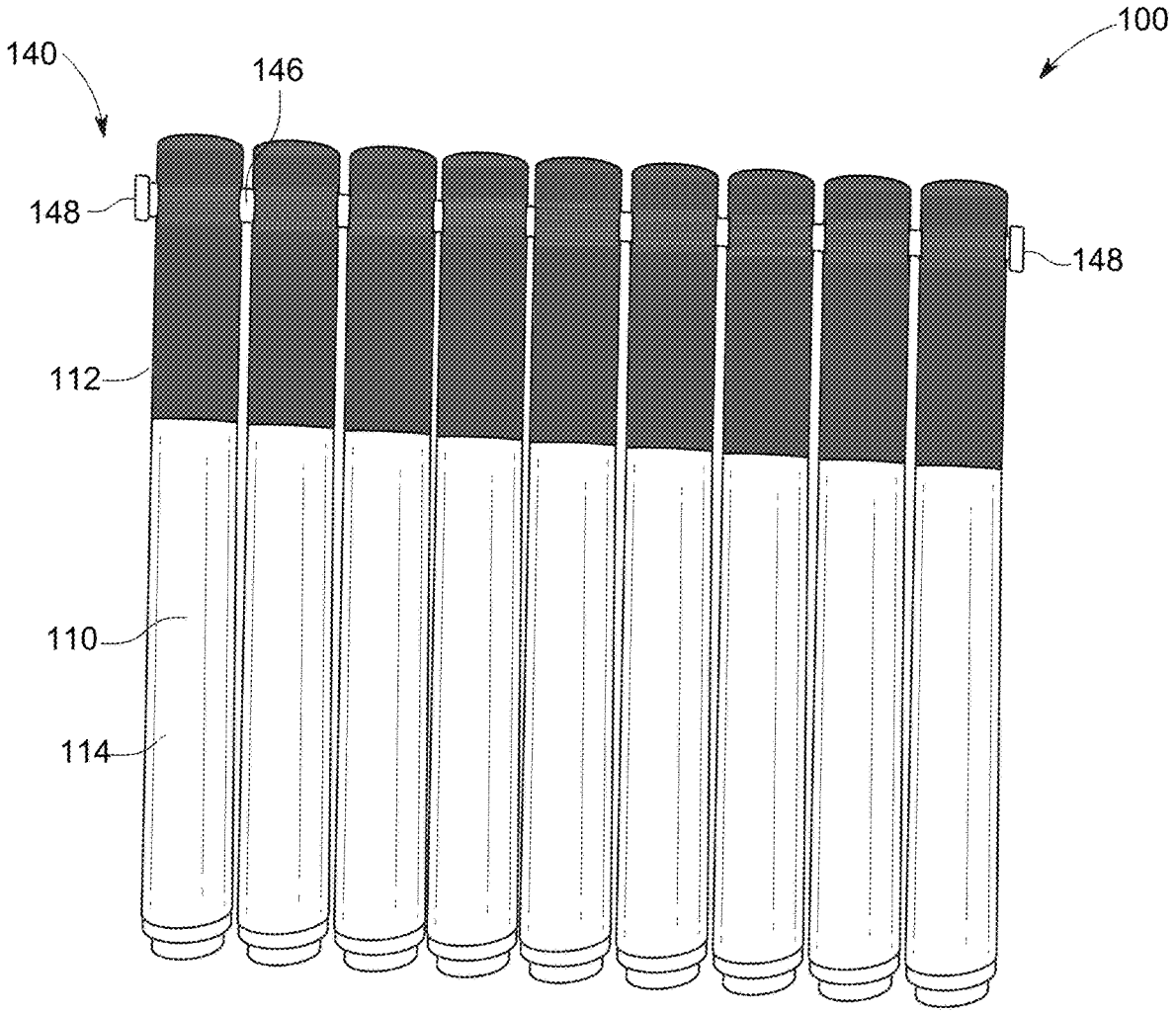
FIG. 1 illustrates a first view of the marker rotation and retention device.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a first view of the marker rotation and retention device is shown.

The marker retention system 100 includes multiple markers 110, each with a cap 112 and barrel 114.

The cap interface 140 includes a shaft 146 with stops 148.

Each cap 112 rotates about the shaft 146, prevented from sliding off by stops 148.

Figure 2:
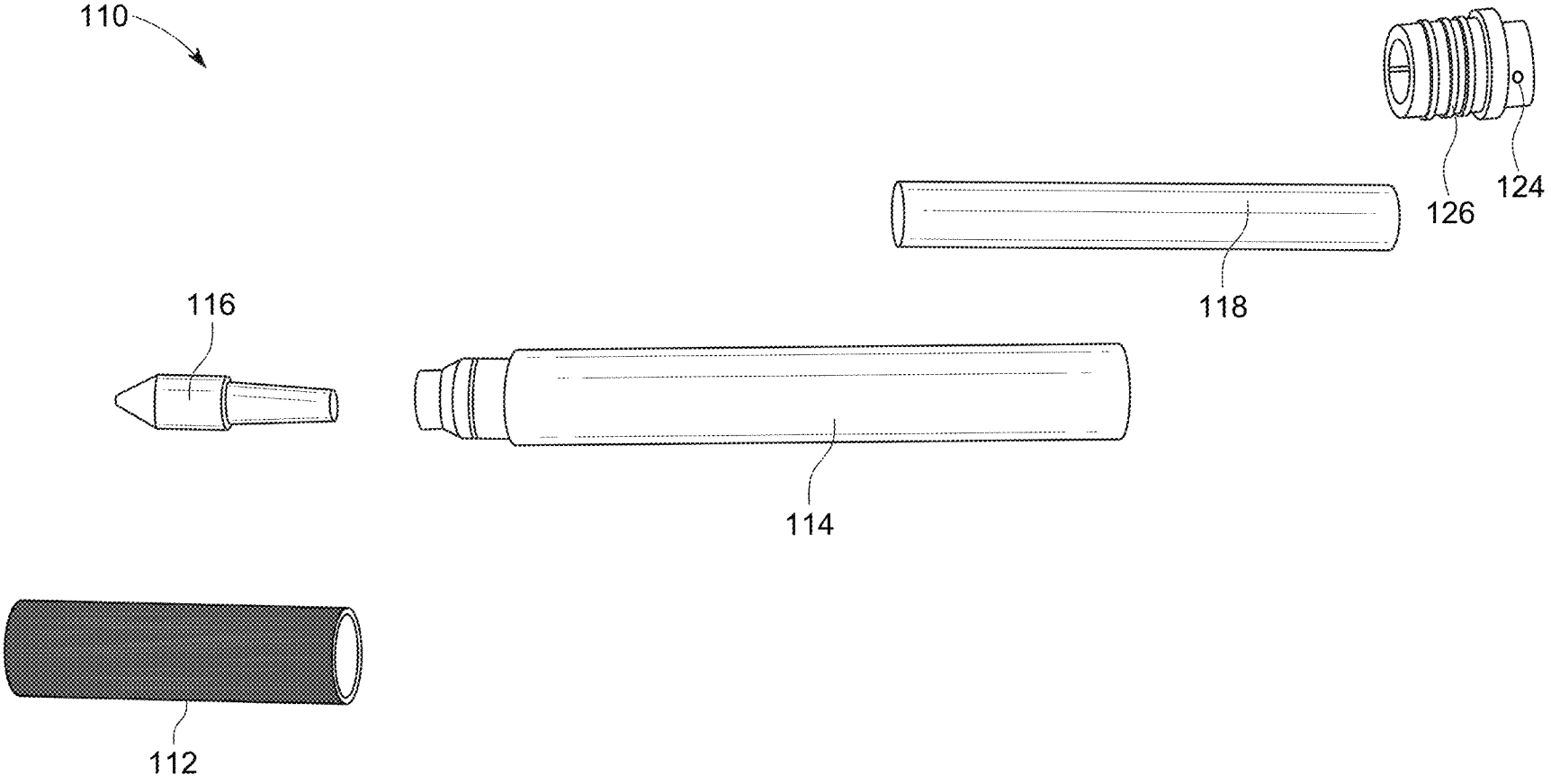
FIG. 2 illustrates a view of a typical marker of the marker rotation and retention device.

Referring to FIG. 2, a view of a typical marker of the marker rotation and retention device is shown.

A typical marker 110 includes a cap 112 that snaps onto the body/barrel 114.

Ink is held within the ink reservoir 118, passing through the tip or nib 116 to be deposited upon the surface, such as paper.

The base 126, which also snaps into the barrel 114, optionally includes a ventilation hole 124.

Figure 3:
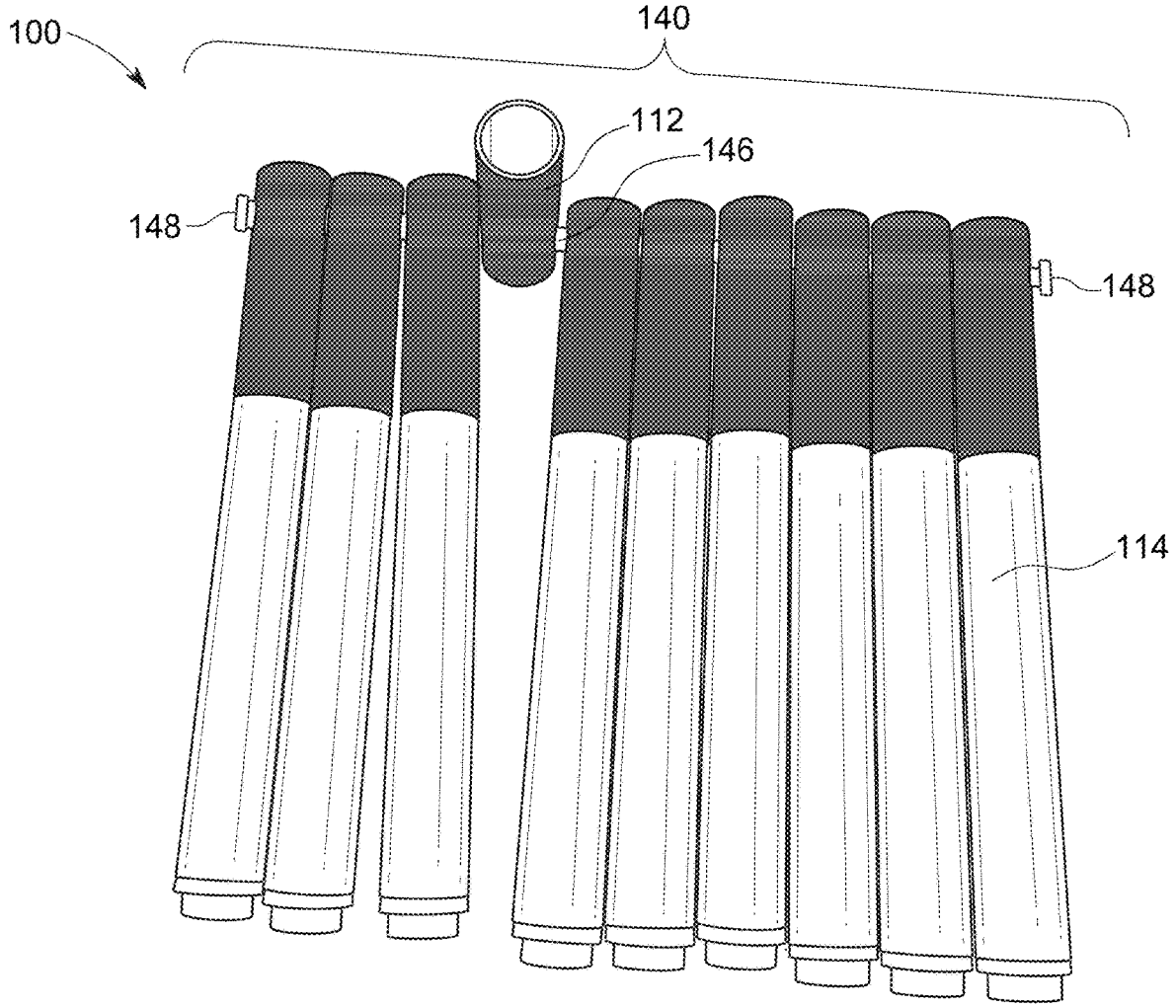
FIG. 3 illustrates a second view of the marker rotation and retention device.

Referring to FIG. 3, a second view of the marker rotation and retention device is shown.

The cap interface 140 of the marker retention system 100 includes the caps 112. The cap 112 rotates about the shaft 146 to allow for removal of the barrel 114, without misplacing the cap 112.

The stops 148 prevent the caps 112 from sliding off the shaft 146.

Figure 4:
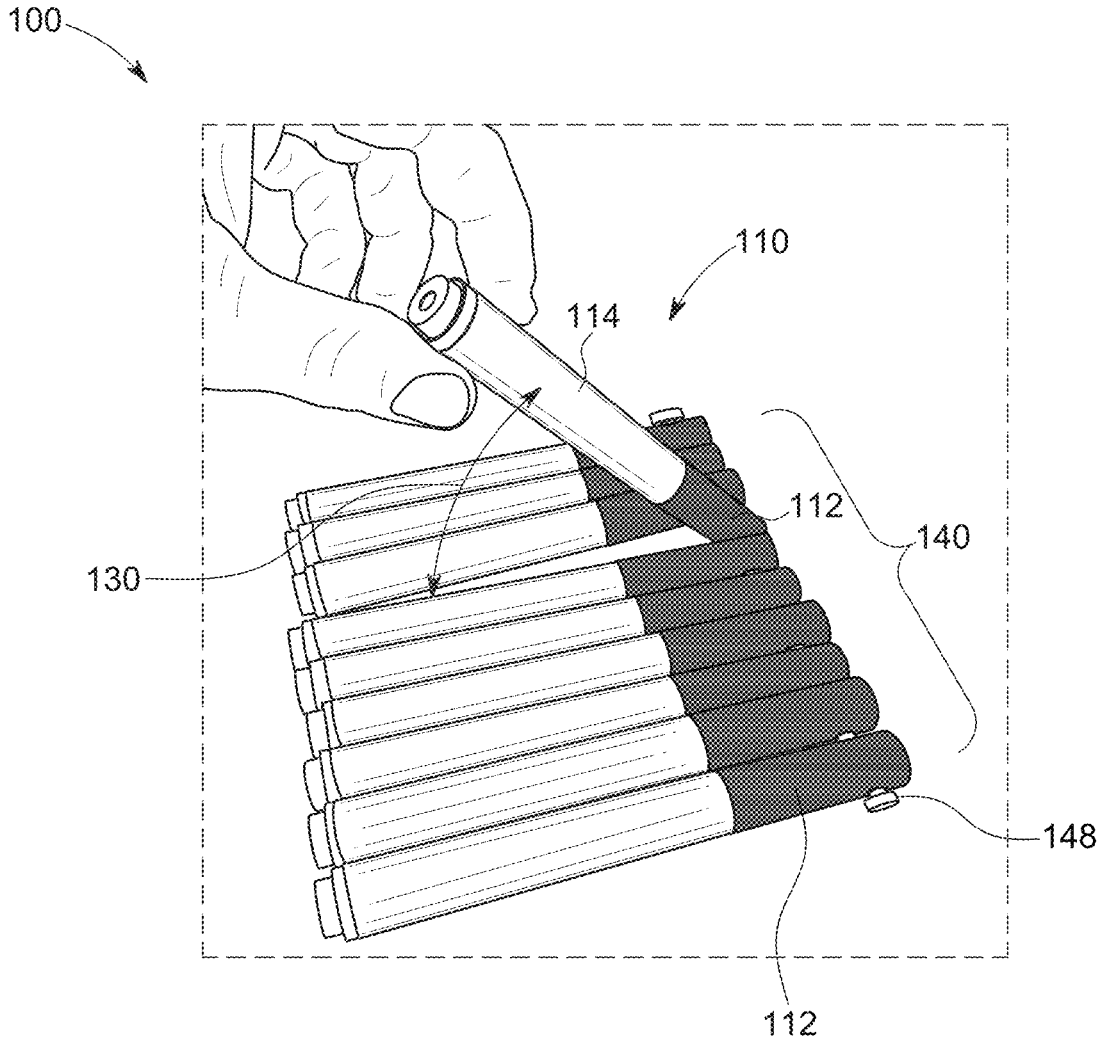
FIG. 4 illustrates a third view of the marker rotation and retention device.
Figure 5:
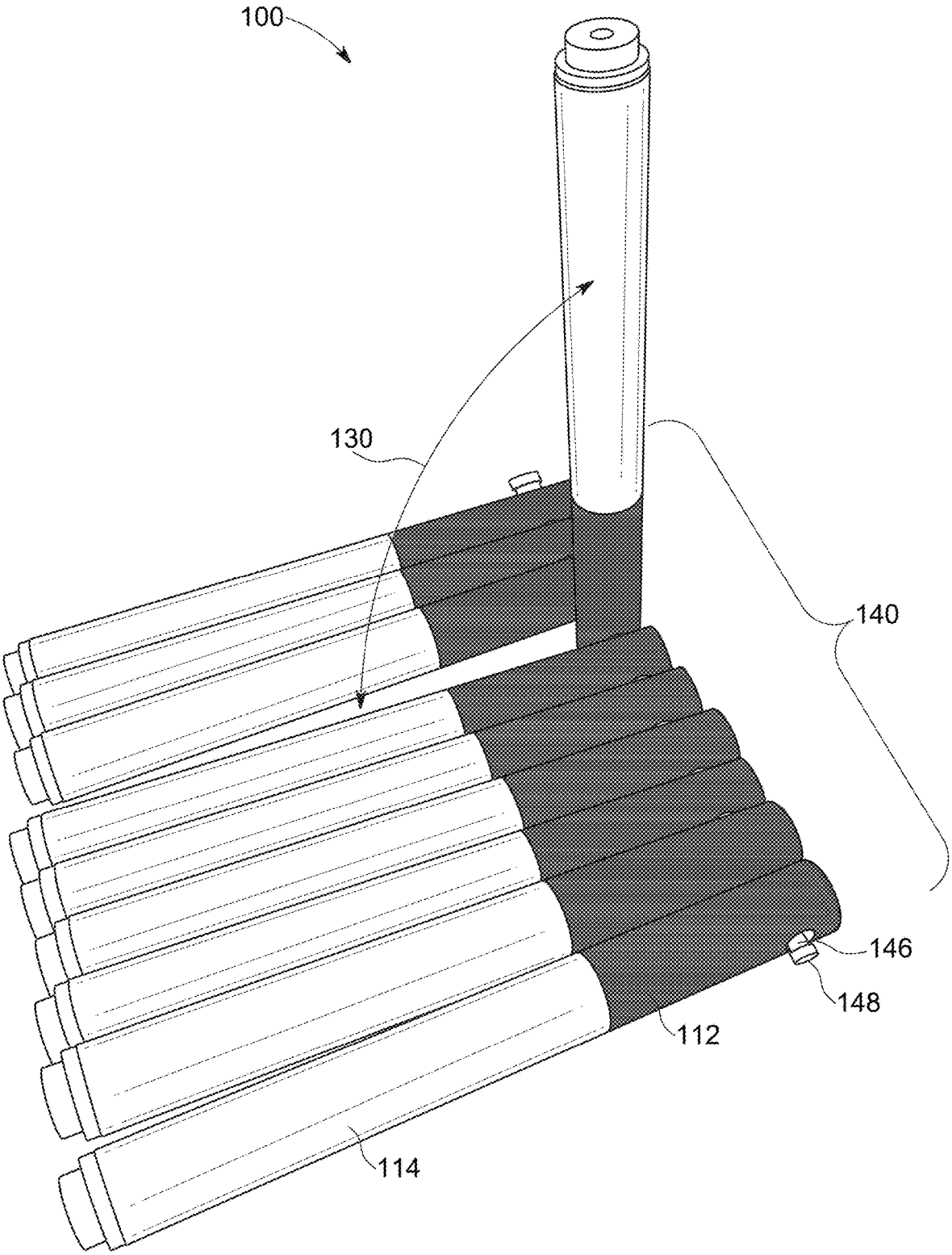
FIG. 5 illustrates a fourth view of the marker rotation and retention device.

Referring to FIGS. 4 and 5, a third view and a fourth view of the marker rotation and retention device are shown.

In the preferred embodiment, a rotation stop is integrated into the interface between the caps 112 and the shaft 146. This allows the user to lift the barrel 114 of a marker 110, the rotation stop holding the cap 112 at an angle 130.

Figure 6:
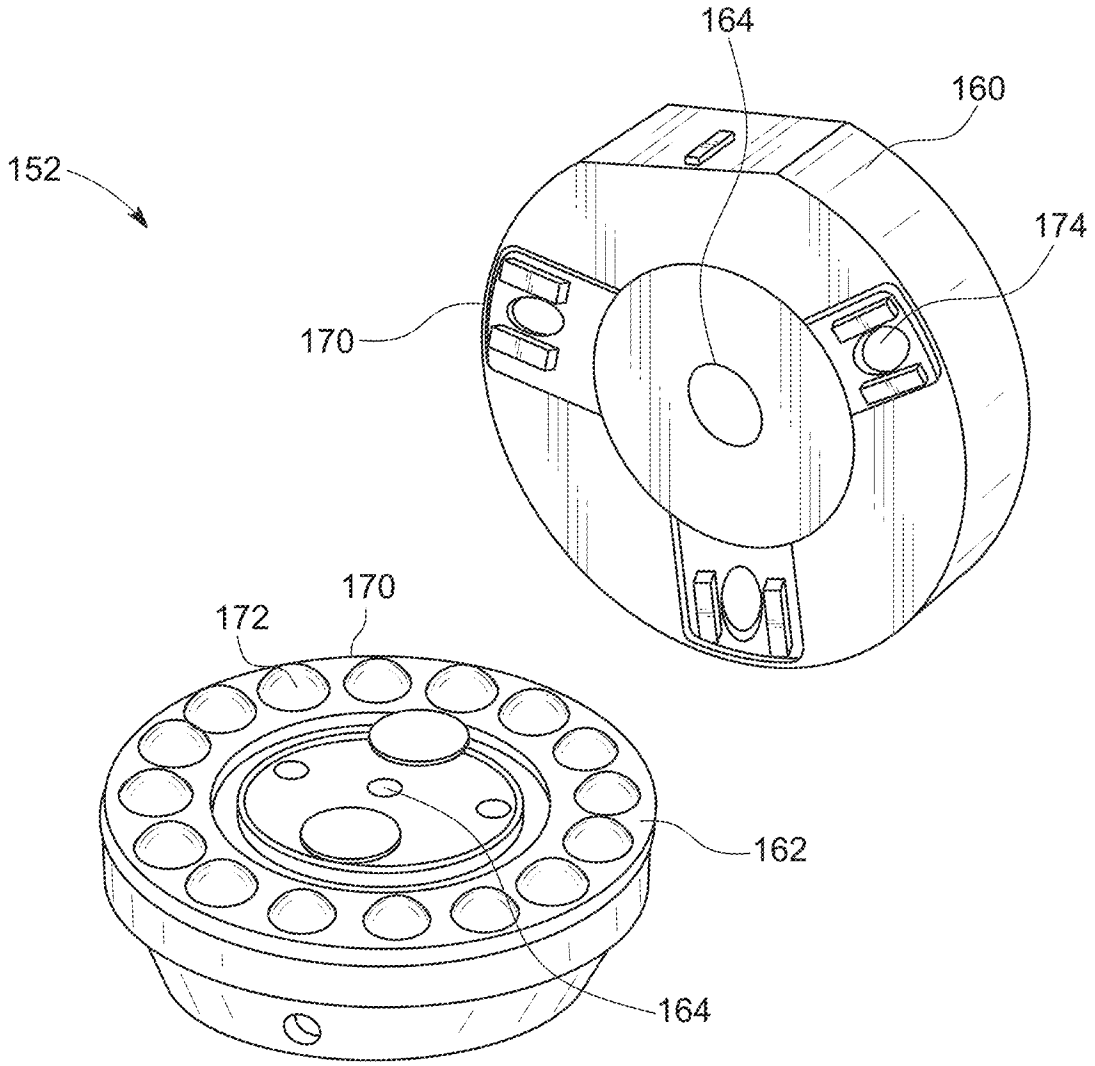
FIG. 6 illustrates an example of an angular stop of the marker rotation and retention device.

Referring to FIG. 6, an example of an angular stop, or rotation stop, of the marker rotation and retention device is shown in a disassembled view.

The angular stop, rotation stop, or marker positioning system 152 includes a first disc 160 that rotates with respect to a second disc 162, rotating about a center hole 164.

Ball detents 170 are placed at different angular positions, the balls 172 interfacing with the detents 174 to maintain the angular position of the first disc 160 with the second disc 162.

Figure 7:
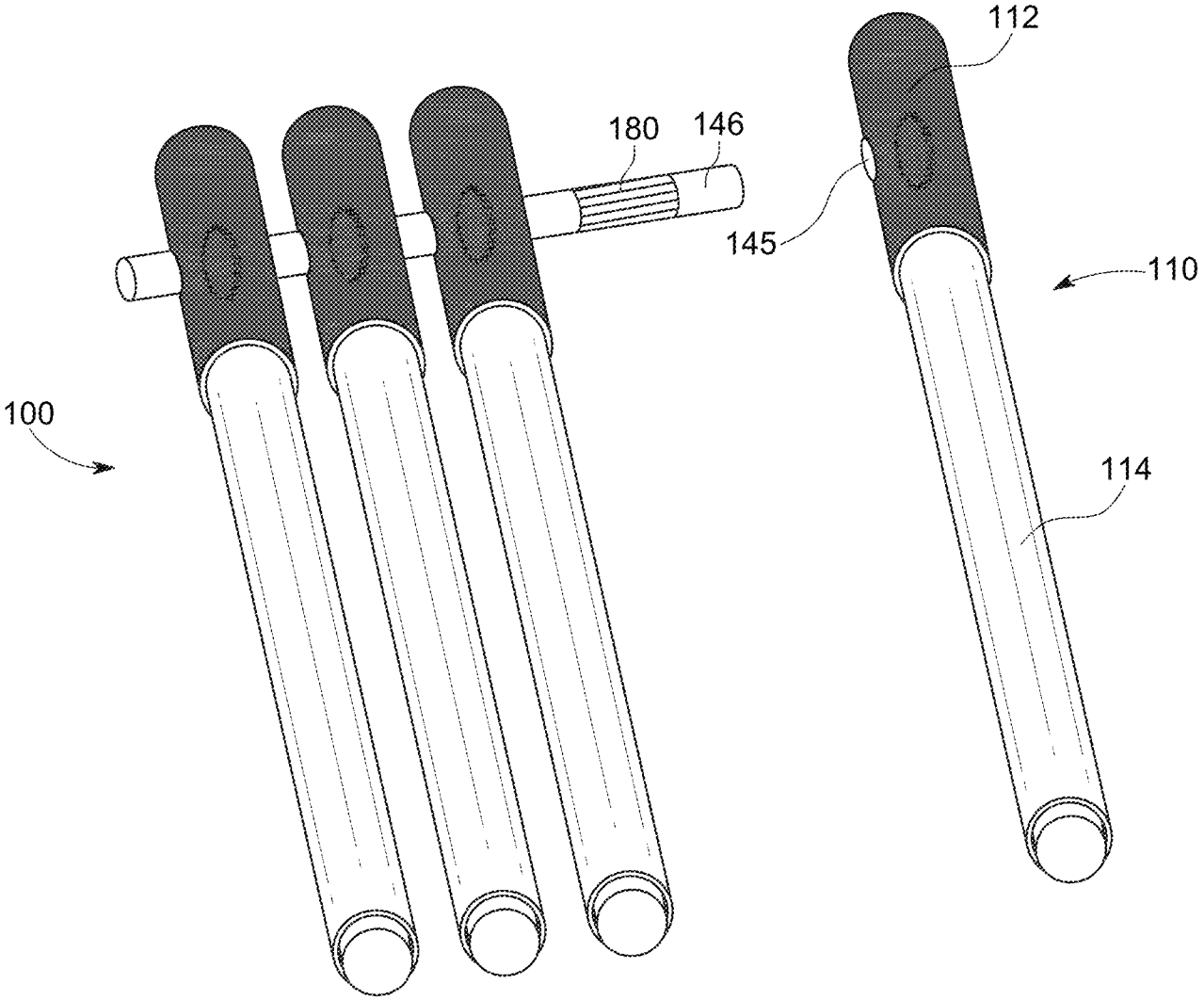
FIG. 7 illustrates a first view of a first embodiment of the marker rotation and retention device.
Figure 8:
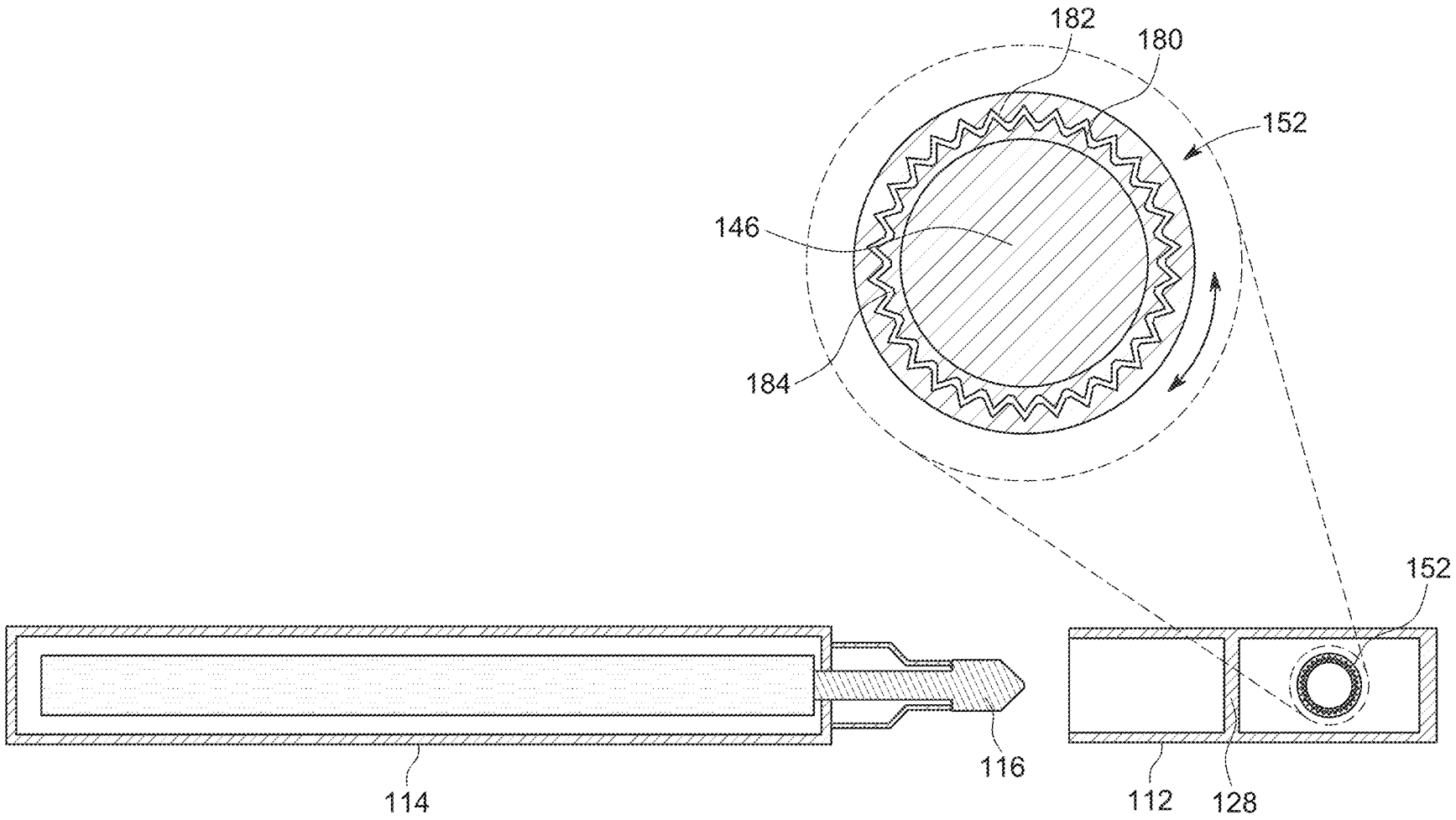
FIG. 8 illustrates a second view of a first embodiment of the marker rotation and retention device.

Referring to FIGS. 7 and 8, a first embodiment of the marker rotation and retention device is shown.

The marker retention system 100 includes a marker 110 with cap 112 and barrel 114. The cap 112 includes a marker positioning system 152 formed from the interaction of two sets of splines—shaft splines 180 and cap splines 182. By forming the shaft splines 180 and or the cap splines 182 from a resilient flexible material, for example flexible plastic, the shaft 146 can be rotated with respect to the cap 112, snapping into different positions as the splines deform and then interface. As a result, the user can choose a position of the cap 112 with the respect to the shaft 146 to withdraw the marker barrel 114.

The shaft 146 passes into the cap 112 at the cap hole 145.

When a marker retention system 100 includes multiple markers 110, rotation of a single marker no will not create sufficient torque to rotate the shaft 146 because it is held in place by multiple stationary markers 110. The result is that only a particular chosen marker 110 will rotate, with the other markers 110 remaining static with respect to the shaft 146.

A dividing wall 128 is preferably placed within the cap 112, preventing the nib 116 from drying out as result of air flow through the spline gap 184 of the marker positioning system 152. The dividing wall 128 separates the cap 112 into a lower section that surrounds the nib 116 and an upper section with the cap splines 182.

Figure 9:
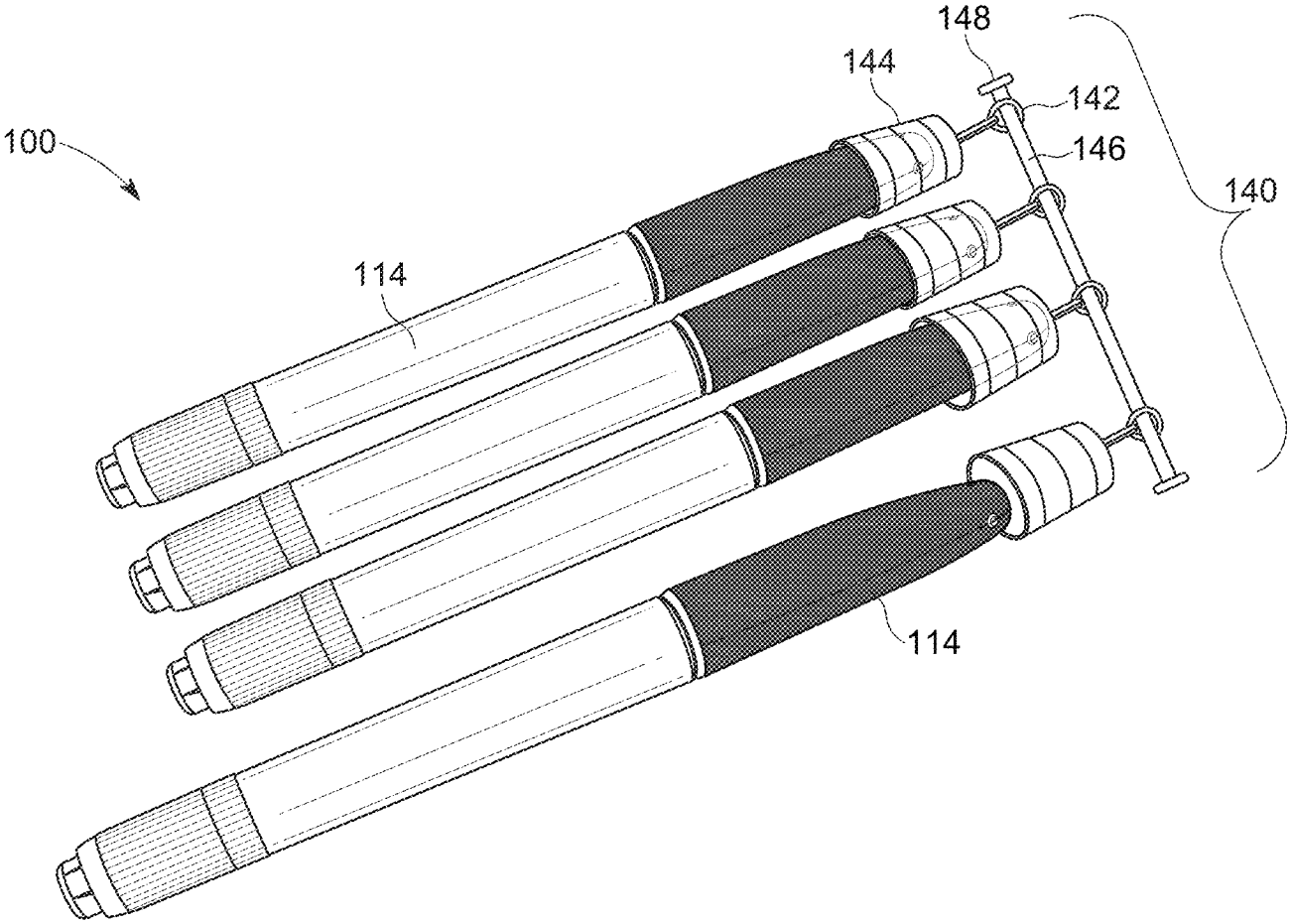
FIG. 9 illustrates a second embodiment of the marker rotation and retention device.

Referring to FIG. 9, a third embodiment of the marker rotation and retention device is shown.

In this embodiment, a cap interface 140 includes a shaft 146 with stops 148 that retain rings 142, which in turn affix to cap receptacles 144. Caps 112 fit into the cap receptacles 144, maintaining organization of the markers 110.

Equivalent elements can be substituted for the ones set forth above such that they perform in substantially the same manner in substantially the same way for achieving substantially the same result.

What is claimed is:

1. A marker retention device comprising:
a shaft;
a plurality of markers;
each marker of the plurality of markers having a cap;
each marker of the plurality of markers having a body;
a splined connection between the shaft and each marker cap;
the splined connection allowing each marker cap to rotate with respect to the shaft;
the splined connection snapping each marker cap to set angular positions with respect to the shaft;
whereby a user rotates the cap to a desired position, the cap is held in the desired position until again rotated by the user.

2. The marker retention device of claim 1 wherein:
the splined connection is cap splines and shaft splines:
the cap splines are formed from a resilient flexible material, allowing the cap splines to deform and move across the shaft splines.

3. The marker retention device of claim 1, further comprising:
a dividing wall;
the dividing wall separating the cap into an upper section and a lower section;
the upper section including the splined connection;
the lower section surrounding a nib of a marker of the plurality of markers;
wherein the dividing wall prevents the nib from drying out.

4. The marker retention device of claim 2, further comprising:
a dividing wall;
the dividing wall separating the cap into an upper section and a lower section;
the upper section including the splined connection;
the lower section surrounding a nib of a marker of the plurality of markers;
wherein the dividing wall prevents the nib from drying out.

5. The marker retention device of claim 2, further comprising:
an ink reservoir filled with ink;
a nib connected to the ink reservoir; and
the nib carrying the ink to a writing surface.

6. The marker retention device of claim 3, further comprising:
an ink reservoir filled with ink;
a nib connected to the ink reservoir; and
the nib carrying the ink to a writing surface.

7. A device to connect a plurality of markers, the device comprising:
individual marker caps connected to a common shaft;
each individual marker cap connected to the common shaft at a splined connection;
the splined connection allowing rotation of each individual marker cap with respect to the common shaft;
each individual marker cap snapping to particular positions with respect to the common shaft.

8. The marker retention device of claim 1 wherein:
the splined connection is cap splines and shaft splines:
the cap splines formed from a resilient flexible material, allowing the cap splines to deform and move across the shaft splines.

9. The marker retention device of claim 1, further comprising:
a dividing wall;
the dividing wall separating the cap into an upper section and a lower section;
the upper section including the splined connection;
the lower section surrounding a nib of a marker of the plurality of markers;
wherein the dividing wall prevents the nib from drying out.

10. The marker retention device of claim 2, further comprising:
a dividing wall;
the dividing wall separating the cap into an upper section and a lower section;
the upper section including the splined connection;
the lower section surrounding a nib of a marker of the plurality of markers;
wherein the dividing wall prevents the nib from drying out.

11. The marker retention device of claim 2, further comprising:
an ink reservoir filled with ink;
a nib connected to the ink reservoir; and
the nib carrying the ink to a writing surface.

12. The marker retention device of claim 3, further comprising:
an ink reservoir filled with ink;
a nib connected to the ink reservoir; and
the nib carrying the ink to a writing surface.

13. A marker retention and rotation device comprising:
two or more markers affixed to a common shaft;
the two or more markers able to rotate with respect to each other about the common shaft;
each marker of the two or more markers including a body and a cap;
each cap interfaced to the common shaft at a splined connection;
the splined connection allowing rotation to a set of specific angles.

14. The marker retention device of claim 1 wherein:
the splined connection is cap splines and shaft splines:
the cap splines formed from a resilient flexible material, allowing the cap splines to deform and move across the shaft splines.

15. The marker retention device of claim 1, further comprising:

a dividing wall;

the dividing wall separating the cap into an upper section and a lower section;

the upper section including the splined connection;

the lower section surrounding a nib of a marker of the plurality of markers;

wherein the dividing wall prevents the nib from drying out.

16. The marker retention device of claim 2, further comprising:

a dividing wall;

the dividing wall separating the cap into an upper section and a lower section;

the upper section including the splined connection;

the lower section surrounding a nib of a marker of the plurality of markers;

wherein the dividing wall prevents the nib from drying out.

17. The marker retention device of claim 2, further comprising:

an ink reservoir filled with ink;

a nib connected to the ink reservoir; and the nib carrying the ink to a writing surface.

18. The marker retention device of claim 3, further comprising:

an ink reservoir filled with ink;

a nib connected to the ink reservoir; and the nib carrying the ink to a writing surface.

* * * * *